United States Patent [19]

Cox, Jr.

[11] 3,972,526

[45] Aug. 3, 1976

[54] INFLATABLE BODY BALLOON

[76] Inventor: James F. Cox, Jr., 904 William St., River Forest, Ill. 60305

[22] Filed: Oct. 7, 1974

[21] Appl. No.: 512,525

[52] U.S. Cl. ..... 272/1 D; 2/2; 2/DIG. 3; 9/341; 272/76; 273/1 R

[51] Int. Cl.[2] ..... A63B 71/12

[58] Field of Search ..... 272/1 D, 76, 1 B; 273/1 R, 55 R; 2/2, DIG. 3; 9/341, 342; 46/87, 88, 90

[56] References Cited

UNITED STATES PATENTS

| | | | |
|---|---|---|---|
| 1,130,778 | 3/1915 | Waskin | 9/341 X |
| 1,336,400 | 4/1920 | Young | 9/342 X |
| 1,419,272 | 6/1922 | Kolberg | 9/342 |
| 1,754,342 | 4/1930 | Tubiolo | 9/342 |
| 2,692,994 | 11/1954 | King et al. | 9/342 X |
| 2,905,954 | 9/1959 | Lanciano, Jr. | 9/342 |
| 3,759,515 | 9/1973 | Crooks | 273/1 R |
| 3,768,467 | 10/1973 | Jennings | 272/1 B X |

*Primary Examiner*—Richard C. Pinkham
*Assistant Examiner*—Richard T. Stouffer
*Attorney, Agent, or Firm*—Fitch, Even, Tabin & Luedeka

[57] ABSTRACT

A recreational and amusement toy for children in the form of an inflated balloon-like jacket which covers the torso, permitting children to bounce or roll off one another while standing erect or while prone upon a lawn or soft-surface play area.

The generally spherical configuration permits the child to quickly return to his feet from either a bounce or roll action when balance cannot be maintained.

Arms can be retracted with bent elbow into the arm openings to permit the child to roll readily on the ground.

3 Claims, 5 Drawing Figures

FIG. 1
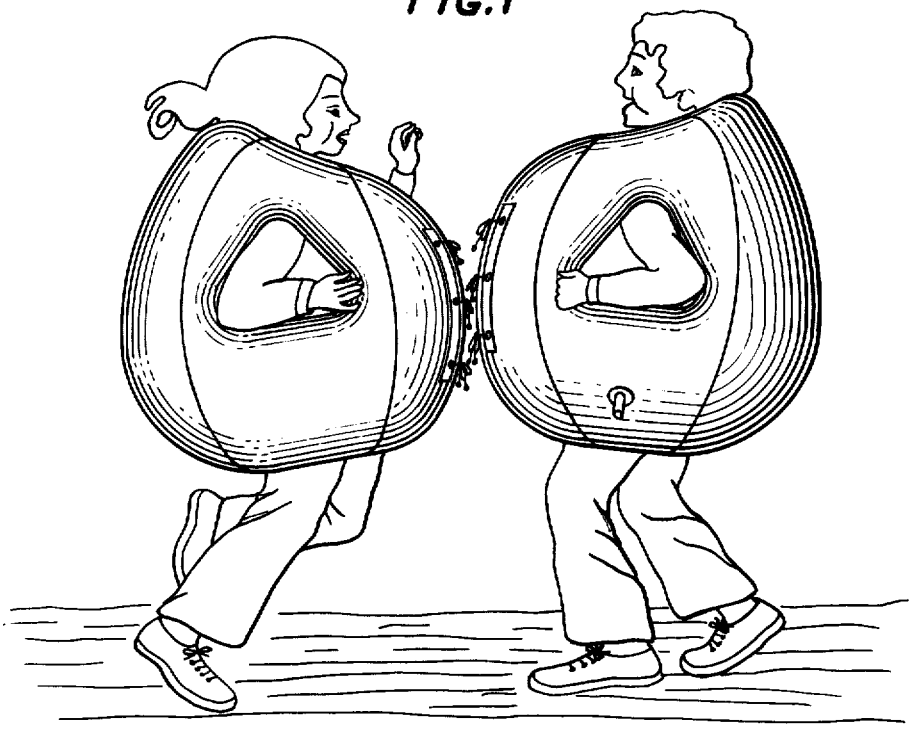
FIG. 4
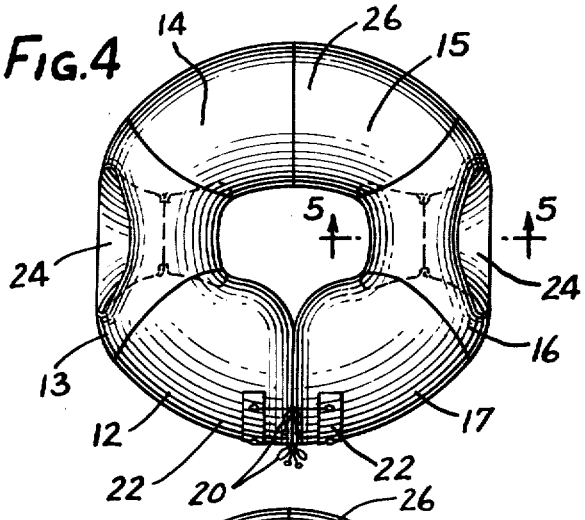
FIG. 5
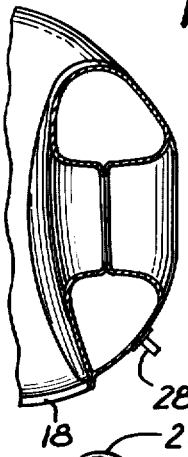
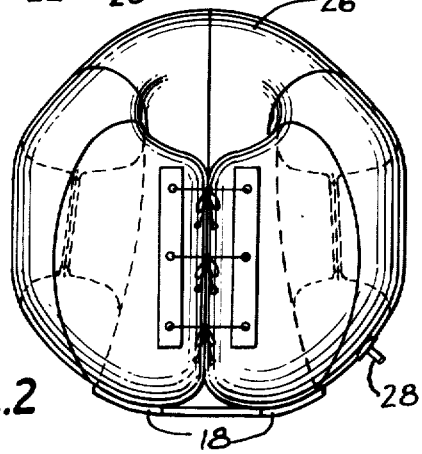
FIG. 2
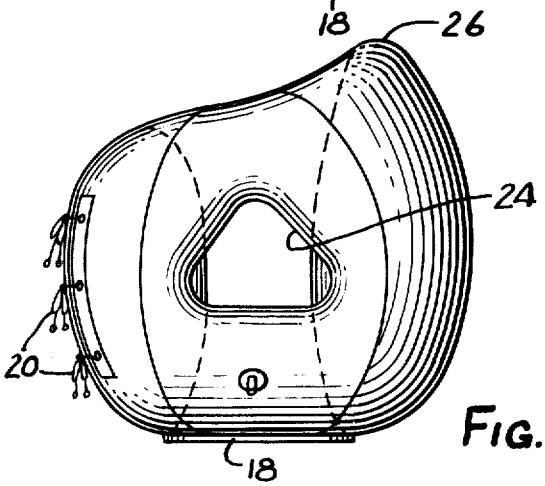
FIG. 3

INFLATABLE BODY BALLOON

This invention relates to a recreational and amusement device for children of all ages.

The device of the invention is an inflatable balloon-like bumper which is worn like a waistcoat, and is of a size preferably capable of investing the child's torso within a surrounding pneumatic enclosure so that a child so garbed may bump against another, or may roll upon the ground in cushioned suspension.

The object of the invention is to let children have fun.

The device of the invention and its intended use will be understood from the following description taken in conjunction with the accompanying drawings, in which:

FIG. 1 is an illustration of two children each invested with the device of the invention and seen in the act of seeking to bump the other off balance;

FIG. 2 is an elevational view of the device seen from the front;

FIG. 3 is a side elevation;

FIG. 4 is a top or plan view; and

FIG. 5 is a fragmentary sectional view taken on line 5—5 of FIG. 4.

In general terms, the amusement device of the invention, as illustrated in the drawings, is a somewhat oblate toroidal balloon 10, i.e., an inflated double-walled encasement of a size suitable to invest at least the torso of a child, with suitable apertures for the protrusion of the head and of the arms and of the legs, while the torso as such, including the shoulders, is encased by pneumatic padding.

The device is constructed of a flexible, air-impervious sheet material, preferably a thermoplastic material such as polyvinylchloride, which is sealable by known techniques, e.g., high frequency heating, to facilitate fabrication of the toy.

To achieve the overall spherical outline of the balloon 10, it is constructed of a number of folded gores 12 to 17 inclusive, preferably six in number, which are connected to each other, and closed along a bottom seam 18, to form a bilaterally symmetrical, body-enclosing, double-walled vestment. The preferred thickness of the pneumatic padding relative to the interior enclosure is shown by FIGS. 3 and 4, the maximum inflated thickness being at least equal to the minimum diameter of the interior enclosure. As indicated in the drawings, the vestment is provided with a front opening 20 to facilitate robing and disrobing in the manner to which a child is accustomed, each of the gores 12 and 17 adjoining the front opening being provided with a closure flap 22 a number of eyelets to receive ties for closing the garment when positioned about the torso. The closure flaps 22 are preferably also of a thermoplastic material, compatably sealable to the gores of the two front sections, but of heavier gauge sheet so as to securely anchor the fasteners. The simple ties illustrated may be replaced with other fasteners if desired, e.g., Velcro or toggle fasteners, or belts with buckles, etc.

The double walls of each of the two side gores 13 and 16 of the device are further sealed to each other in a closed loop and the encircled material removed to provide an armhole aperture 24 at each side of the balloon-like vestment. The thickness of the cushion around the armhole apertures (FIG. 5), is approximately equal to the minor diameter of the torso enclosure so as to permit the retraction of the arms alongside the torso and substantially within the outline of the inflated toy. The armhole aperture may simply be round, or of any shape adequate to permit the protrusion of the arm, but is preferably triangular, as indicated particularly in FIGS. 1 and 3, to permit the retraction of the arm, when bent, into or substantially into the armhole, as indicated in FIG. 1.

The two side gores 13 and 16, and the two rear gores 14 and 15, are preferably cut to increase in height from front to rear so as to provide a self-contained cowl or cushion 26 behind the wearer's head.

The closure seams 18 for all of the connected gores are preferably made along the bottom edge of the vestment in order to provide a smooth, rounded top, and one of the outer walls of one of the gores is provided with a conventional inflation stem 28 through which the vestment is inflated.

The device is simple to use and enjoy. It provides vigorous body exercise in a game which requires no athletic skill, and which may be enjoyed by boys and girls alike in mixed play as a delightfully giddy and sometimes hilarious experience.

I claim:

1. A recreational and amusement toy to be worn upon the human form, comprising a double-walled garment for investing the torso of the human form and having at least an upper aperture for the protrusion of the wearer's head, armhole apertures at each side for the protrusion of the wearer's arms, and a lower aperture for the protrusion of the wearer's legs, the walls of the garment being assembled by sealing together a plurality of gores of flexible, air-impervious sheet material to constitute an inflatable closed chamber for encasing the torso of the wearer while permitting the head, arms, and legs of the wearer to protrude through said apertures, and a closable vent in at least one of the walls for inflating the toy, said gores being shaped and proportioned such that said toy when inflated and worn provides a bulbous, pneumatic collision cushion of toroidal outline with the interior thereof forming an enclosure for the torso of the wearer, said cushion having a maximum thickness at least equal to the minimum diameter of said enclosure, said gores being of such a size and shape in the vicinity of said armhole apertures that when said cushion is fully inflated, the thickness of said cushion around said armhole apertures is approximately equal to said minimum diameter of said enclosure so as to permit the retraction of the arms alongside the torso of the wearer and substantially within the outline of the inflated toy.

2. The device of claim 1 in which the garment is provided with a closure having a fastener to retain the garment on the torso when inflated.

3. The device of claim 1 wherein the garment when inflated provides a protective cushion for the back of the wearer's head.

* * * * *